US007188729B2

(12) United States Patent
DeJonge

(10) Patent No.: US 7,188,729 B2
(45) Date of Patent: Mar. 13, 2007

(54) CHILD RESISTANT BLISTER PACK CONTAINER FOR STACKED BLISTER PACKS

(75) Inventor: Stuart W. DeJonge, Lake Ariel, PA (US)

(73) Assignee: DeJonge Associates, Inc., Deland, FL (US)

( * ) Notice: Subject to any disclaimer, the term of this patent is extended or adjusted under 35 U.S.C. 154(b) by 177 days.

(21) Appl. No.: 11/039,627

(22) Filed: Jan. 20, 2005

(65) Prior Publication Data

US 2006/0157374 A1 Jul. 20, 2006

(51) Int. Cl.
*B65D 83/04* (2006.01)
*B65D 85/62* (2006.01)
*A45C 13/12* (2006.01)

(52) U.S. Cl. ..... 206/535; 206/1.5; 206/499; 220/326

(58) Field of Classification Search ..... 206/528–539, 206/1.5, 425, 499; 220/326
See application file for complete search history.

(56) References Cited

U.S. PATENT DOCUMENTS 625,757 A 5/1899 Groneman
3,888,350 A 6/1975 Horvath
3,942,630 A 3/1976 Phillips
4,284,204 A 8/1981 Carey, Jr.
4,889,238 A 12/1989 Batchelor
5,033,634 A * 7/1991 Batchelor et al. ..... 206/1.5
5,368,187 A 11/1994 Poncetta et al.
6,036,018 A 3/2000 Harrold
6,173,838 B1 * 1/2001 Brozell ..... 206/538
6,460,693 B1 * 10/2002 Harrold ..... 206/1.5
6,681,935 B1 1/2004 Lewis
6,708,826 B1 * 3/2004 Ginsberg et al. ..... 206/535
6,726,053 B1 4/2004 Harrold

* cited by examiner

*Primary Examiner*—Bryon P. Gehman
(74) *Attorney, Agent, or Firm*—Kenneth P. Glynn

(57) ABSTRACT

A child resistant blister pack container for stacked blister packs includes a bottom member, a top member, and a child resistant push and lift mechanism. The bottom and top members, once filled and assembled, cannot be separated. They work together with a locking mechanism to assure that the stack of blister packs are secured, and that, upon removal of a blister package from the pack, the sealed medication of that package is automatically opened for use. This important feature prevents or discourages users from removing multiple packages that might other wise be unprotected until used.

16 Claims, 5 Drawing Sheets

CHILD RESISTANT BLISTER PACK CONTAINER FOR STACKED BLISTER PACKS

BACKGROUND OF THE INVENTION

1. Field of the Invention

The present invention relates to child resistant blister pack containers that hold stacked blister packs so that multiple requirements for enhanced safety are provided. First, the containers require compound movement to be opened. Second, the individual medication blister packs are clamped or otherwise locked into the containers. Third, when a blister pack is removed it is torn or otherwise opened to expose the medication.

2. Information Disclosure Statement

The following patents relate to child resistant and other medicine containers:

U.S. Pat. No. 625,757 to Fred C. Groneman describes a blank for making a medicine-box consisting of a four-sided central part adapted to form the bottom of the box mating outward, extensions at the parallel sides and adapted to form the vertical sides of a box and narrow strips along the outer edge portions of said extensions adapted to be turned inward their entire length to produce guards from one end of the box to near the other end, extensions at the ends of the central portion adapted to produce the ends of the box and one of said end extensions provided with a curved line of perforations to facilitate removing a section of one end to gain access for removing medicine from the box, substantially as shown and described for the purpose stated.

U.S. Pat. No. 3,888,350 to William Horvath describes a snap lock and squeeze open slide top container that has a small centered catch depending from the inner face of the cover. The edge of the catch forms with the closed end of the cover a slot which accommodates the rear edge of the drawer portion of the container. The profile of the catch is tapered, forming an inclined plane directed to the front end of the container. The cover and drawer are slidably engaged by lateral meshing flanges which are interrupted near the closed end to provide slight clearances between the inside of the cover and the outside of the drawer. These clearances, together with an inverted V-shaped cut centered in the rear skirt of the cover, permit the cover to bow up when the sides are squeezed, releasing the edge of the drawer portion from the slot formed by the catch to open the drawer. When the drawer is closed, the edge portion rides forward along the inclined plane depending from the cover, engaging the slot with a click, to lock the container closed. To prevent spillage, the opening of the drawer is limited by a pair of small stops depending from the inner face of the cover near each sidewall, which ride in elongated recesses in the lateral walls.

U.S. Pat. No. 3,942,630 to Otto Phillips describes a sliding cover safety package including a container having a cover mounted thereon for slidable movement between open and closed positions with respect to the container. The container and cover are provided with locking lugs having a locked position when the cover is closed in which the cover is locked against movement from its closed position with respect to the container, and an unlocked position when the cover is closed in which the cover can slide with respect to the container to its open position. The locking lugs are movable between the locked and unlocked positions by axial movement of the cover with respect to the container. Resilient biasing member is engaged between the container and cover to bias the locking lugs to the locked position such that the cover can slide from it closed position with respect to the container only after axial movement of the cover with respect to the container against the biasing members.

U.S. Pat. No. 4,284,204 to Howard M. Carey, Jr. describes a two-part package which includes a sleeve for receiving a tray. One surface of the sleeve has openings formed therein for receiving dimpled, detents formed in the tray. As the tray is fully positioned in the sleeves, the detents engage the openings and retain the tray thereby inhibiting unwanted opening of the package and release of contents. Upon exertion of sufficient manual force on the sides of the sleeve, detent action is overcome and the package is opened as desired.

U.S. Pat. No. 4,889,238 to Jay A. Batchelor describes a medicament package for improving compliance with a therapeutic regimen. The therapeutic regimen involves a plurality of medication administered to a patient in a prescribed sequence and in accordance with specified intervals. The package includes a multiplicity of blister cards of generally uniform planar dimensions. The blister cards carrying the medicaments in sequential order on the individual cards and from card to card. The blister cards being placed in stacked array with the principal dimensions thereof oriented generally horizontally and arranged in order of use with the first to be used topmost. Also included is a base which houses the stack of blister cards and is adapted to support the stack vertically and provides lateral support to the edges of the blister cards. The base permits direct and unobstructed access to the uppermost blister card and limited access only to the edges of the blister cards. A lid is adapted to cover the base and movable to an open position allowing access to the uppermost blister card. Each blister card generally contains indicia denoting the order and sequence when the contents of a particular blister cavity are to be consumed.

U.S. Pat. No. 5,368,187 to Stanley Poncetta et al. describes a dispenser and method for dispensing materials from a blister pack of one or more blister cards. A single blister card having a plurality of blister thereon can be used with other blister cards in a stack. To dispense materials from the aligned blisters of stacked blister cards, a plunger is driven through a guide hole in a top plate and into aligned blisters of a stack of blister cards. In this way, a plurality of blisters can be quickly and cleanly opened. Thus, a plurality of medical pills can be liberated from the blisters and can easily gravitate to a collection region below the stack of blister cards. Several embodiments of the mount for blister card stack is disclosed.

U.S. Pat. No. 6,036,018 to John E. Harrold describes a child resistant container for blister packs with a housing with an opening, and slides located inside the housing which position and retain several drawers inserted into the opening. A latching mechanism is provided to engage and retain each of the drawers when inserted into the housing. The latching mechanism has cooperating male and female parts located on the drawer and the housing in positions complimentary to each other. The part located on the housing is functionally operable with a latching trigger slidably connected to the housing. Resilient living springs are provided to urge each of the drawers into latching engagement and, when a drawer is pushed in against the spring, moves to partially disengages the drawer. The latching trigger moves the latching mechanism into a second position fully disengaging the drawer for removal. The remainder of the drawers which have not been pushed in remain retained in the safety container by the latching means.

U.S. Pat. No. 6,681,935 to Graham L. Lewis describes an integrated medicament package which comprises a prefabricated medicament container having a plurality of initially open top blisters a closure cover affixed to one marginal edge thereof by at least one living hinge, the closure cover having at least one clasp on an open end of the closure cover opposite the living hinge, the blisters arranged in rows and columns separated by longitudinal and transverse shoulders, at least one of the longitudinal and the transverse shoulders having perforations therethrough wherein the prefabricated medicine container is adapted to be separated along the perforations into a plurality of units, and a sealing sheet with medicament information at a location corresponding to the at least one said plurality of blister such that the medicament information on the outside surface of the sealing sheet corresponds with the medicament in the blisters, the medicament information comprising the name of the patient, the time of day, the day of week and the calendar date for the patient to take the medicament in the blister, the sealing sheet when removed from the location indicates to the patient that the medicament has been taken.

U.S. Pat. No. 6,726,053 to John E. Harrold describes a child resistant multiple dosage blister pack dispenser which includes a main housing bottom component having walls and bottom panel for supporting a blister pack, and a main top component. The bottom panel has a plurality of orifices located so as to position a blister pack thereabove, with individual dosages of the blister pack located above the orifices. These orifices are of sufficient size and shape to push individual dosages from the blister pack therethrough. The main housing top component is permanently connected to the bottom component and laterally moveable relative to the bottom component. The top component has a first position, being a rest position, and having a second position, being a dispensing position. There is a biasing spring connected to at least one of the bottom component and the top component, that biases the top component relative to the bottom component so that the top component is in its first position. There are a plurality of push tabs located on the top component in an array corresponding to the plurality of the orifices on the bottom component. These plurality of push tabs are not located above the orifices or the individual dosages when the top component is in its first position. Further, the plurality of push tabs are located above the individual dosages and the bottom component orifices for pushing dosage from the blister pack therethrough when the top component is in its second position.

Notwithstanding the prior art, the present invention is neither taught nor rendered obvious thereby.

SUMMARY OF THE INVENTION

The present invention is a child resistant blister pack container for stacked blister packs. The term "blister" as used herein means a sealed bubble or pouch for maintaining sanitary conditions of an enclosed medication, chemical or material. Blisters include plastic, foil, paper, treated paper, and combinations. Two examples are clear bubble top with foil bottom, and plastic top and bottom pouch. Some are rigid bubbles and others are flexible.

The present invention child resistant blister pack container includes a bottom member, a top member, and a child resistant push and lift mechanism. The bottom and top members work together to assure that a stack of blister packs are secured and that, upon removal of a blister package from the pack, the sealed medication of that package is automatically opened (exposed) for use. This important feature prevents or discourages a user from removing multiple packages that might otherwise be unprotected (no longer child resistant) until used.

The bottom member has a bottom section, sidewalls, and a back section, and has a locking area located toward the back section. The locking area includes at least a component of locking means for locking a stack of blister packs to the bottom member. The locking means component may operate in conjunction with a locking means component of the top member, a separate (third) piece, or may have the entire locking mechanism connected to it.

The top member is attached to the bottom member, the top member having a top section, sidewalls, and a back section. The top member is adapted to connect with the bottom member. The top member has a fixed top section toward the back section, and has a lid top section hingedly connected to the fixed top section. The lid top section has an open upwardly hinged position and a closed position, wherein, when in the closed position, the lid top section closes onto the bottom member sidewalls.

The child resistant push and lift mechanism has a spring-based push tab and a tab lock, wherein the tab has a locked position in its rest position and has an unlocked position in its pushed position, one of the push tab and the tab lock being attached to the bottom member and the other being attached to the top member, such that when the top member is in its closed position, the push tab is locked by the tab lock and the lid top section cannot be opened until the push tab is in its pushed position.

A plurality of stacked blister packs is inserted into the container. The blister packs are of a type of blister pack having a locking end and an opposing sealed medication end with a breakaway mechanism therebetween so that a breakaway action separates the sealed medication end from the locking end and unseals the medication, the plurality of stacked blister packs being locked at the locking end with said locking means of the bottom component.

When the lid top section is closed, a user must push the push tab, lift said lid top section and breakaway a sealed medication end of a blister pack to procure medication from the container.

In some embodiments, the bottom member has a locking means component that includes at least one post extending upwardly from the bottom member, and a clamping mechanism is also provided as a part of the container such that a stack of blister packs having corresponding perforations may be stacked on the at least one post and clamped in place. In some embodiments, the clamping mechanism is connected to an underside of the fixed top section.

In some preferred embodiments, there may be two clamping mechanisms, the same or diverse, that act as the blister pack locking means. In yet other embodiments, the locking means may be located contiguous to the breakaway mechanism of the blister.

In some embodiments, the bottom member and the top member may have rectangular top view shapes, although any shape could be used, e.g. to conform to an oval blister pack, or simply to have another shape, such as a hex or a circle.

The child resistant push and lift mechanism may be located on the sidewalls. There may be one or there may be two, opposing, child resistant push and lift mechanisms on the sidewalls.

The bottom member and the top member may include interlocking means for permanent connection of the bottom member and the top member to one another.

The present invention is also directed to a blister pack for use in the present invention container. This blister pack includes a bottom member and a top member with a blister enclosing a medication, the blister pack having a locking end and a sealed medication end containing said blister, and having a breakaway mechanism between the locking end and the sealed medication end and passing into the blister, said locking end including locking means for locking the blister pack to a container, wherein when the sealed medication end is separated from the locking end at the breakaway mechanism, the blister is opened to expose medication.

In some embodiments the breakaway mechanism is selected from the group consisting of perforations, thins, narrowing section or combination thereof. The locking means may be selected from the group consisting of at least one orifice, a key, an increased thickness area, and combinations thereof.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
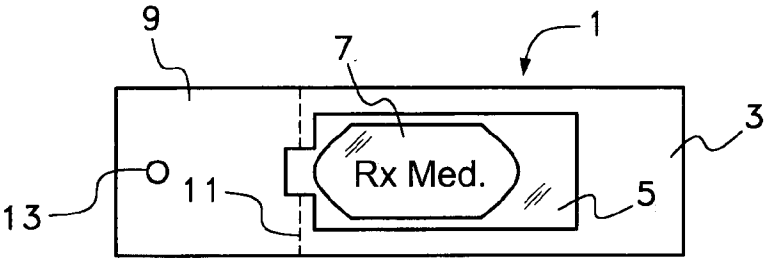
FIG. 1 illustrates a top view of a present invention child resistant blister pack for a present invention container for stacked blister packs.
Figure 2:
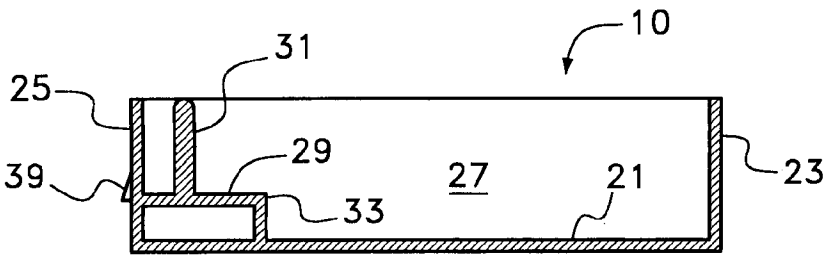
FIGS. 2 and 3 show side cut views respectively of the bottom component and the top component of a present invention child resistant blister pack container.
Figure 3:
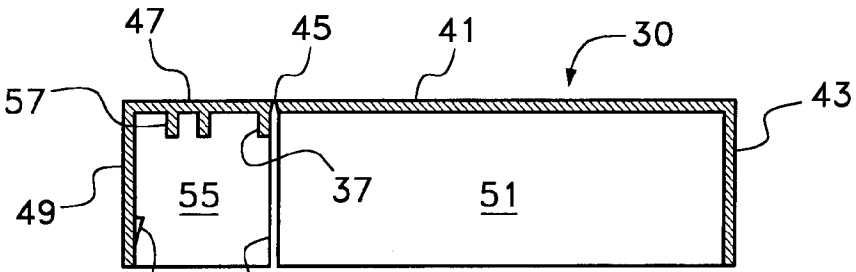

FIG. 1 illustrates a top view of a present invention child resistant blister pack for a present invention container for stacked blister packs, and FIGS. 2 and 3 show side cut views respectively of the bottom component and the top component of a present invention child resistant blister pack container. In these FIGS. 1 through 3, identical parts are numbered identically, and all three Figures are discussed collectively.

The blister pack 1 has a sealed medication end 3 with medication capsule 7 or other product enclosed and sealed in blister 5 (in this case, a pouch). Locking end 9 is separated from sealed medication end 3 by perforations 11. Locking end 9 has a locking means component, here, orifice 13, for attachment to a post. Perforations 11 are positioned so that when blister pack 1 is attached to a post via orifice 13 (and it may also be compressed and further locked by a boss and ledge at the perforations 11), and a user pulls on sealed medication end 3, end 3 tears away all perforations 11, and rips open blister 5, exposing the capsule 7 by removing the back end of the blister 5. Instead of perforations 11, thins, folds, narrowing or other rip-guiding mechanism could be employed to achieve the same results. Examples of these are discussed below. Instead of capsule 7, there could be any type of medication, pill, chemical, or other material. One such alternative is a medicinal strip that itself may be sealed or on a strip substrate.

Although not required, it is preferred for some products that the blister or pouch end closest to the locking end be narrowed or otherwise restricted to prevent the product itself from being positioned at the rip-guiding mechanism so that the product is not damaged, broken or torn during the ripping/removal process. This narrowing feature is shown in a number of the figures herein.

In FIGS. 2 and 3, bottom member 10 and top member 30 cooperate to create a present invention child resistant blister pack container. Bottom member 10 includes a bottom section 21, a back section 25, a front section 23 and opposing sidewalls, such as sidewall 27. Bottom section 21 has a locking area 29 toward back section 25. The locking area 29 includes an elevated locking means component, here, post 31 adapted to receive a stack of blister packs like pack 1, by placing orifice 13 onto post 31 with multiple packs, and then closing top member 30 over it. Also, the front ledge 33 and the boss 37 cooperate to clamp the stack of blister packs adjacent the perforations to increase the effectiveness of the device and the process.

In this example, there are two posts next to each other for side by side blister pack stacking. Top member 30 has a top section, a front section 43, a back section 49 and sidewalls. The top section has a lid top section 41, a hinge 45 and a fixed tip section 47 with boss 37. Wall 55 is connected to fixed top section 47, and wall 51 is connected to lid top section 47 and front section 43, as shown. These lift up together at hinge 45 and cut 53. The walls 51 and 55 have corresponding opposing walls not shown.

There are two post caps, such as cap 57, for fitting onto the posts. These posts and caps preferably include one way catches, ratchets or other known mechanisms that will prevent their separation once they are connected. There are also attachment means 35 and 39 for interconnecting to prevent separation of bottom member 10 and top member 30 once they are snapped together.

Figure 4:
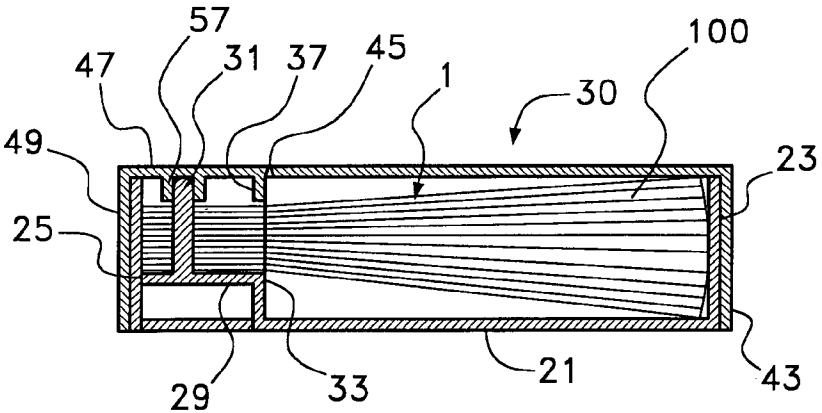
FIGS. 4 and 5 show a cut side view and a cut end view, respectively, of the container of the present invention and blister packs of the present invention as set forth in the previous Figures.
Figure 5:
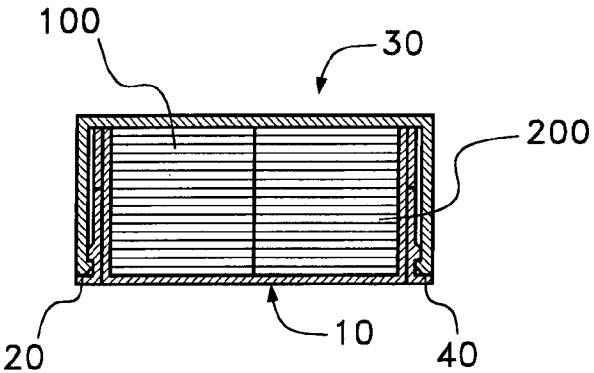

FIGS. 4 and 5 show cut side and cut end views respectively of the present invention container members shown in FIGS. 2 and 3, with stacks of blister packs such as that shown in FIG. 1. Identical components from above are identically numbered and need not be repeated here. Blister pack stack 100 has a plurality of blister packs 1 (FIG. 1) attached to post 31, and a corresponding stack 200 attached to a second post (not shown). The raised platform locking area 29 accommodates the thickness differences between the flat locking end 9 and the much thicker medication-containing sealed end 3. Also, ledge 33 and boss 37 clamp the stacks, as indicated above.

As shown in FIG. 5, side-by-side stacks 100 and 200 are contained within the child resistant container, although a single stack could be accommodated by having a single post arrangement with a narrower container or by having wider blister packs, e.g. with two capsules, and with two post-aligned orifices.

Also shown in FIG. 5 are two child resistant push and lift mechanisms 20 and 40. These are pushed in at their bottoms to release interlocking members to enable a user to lift up the lid section 41 of the top member 30, otherwise the container cannot be opened. Thus, a user squeezes the push and lift mechanism and lifts the top to open and pulls off a blister pack which automatically causes a rip in the blister (This discourages premature removal of blister packs). The lid section is closed and again rendered child resistant, again requiring compound motion to be reopened.

Figure 6:
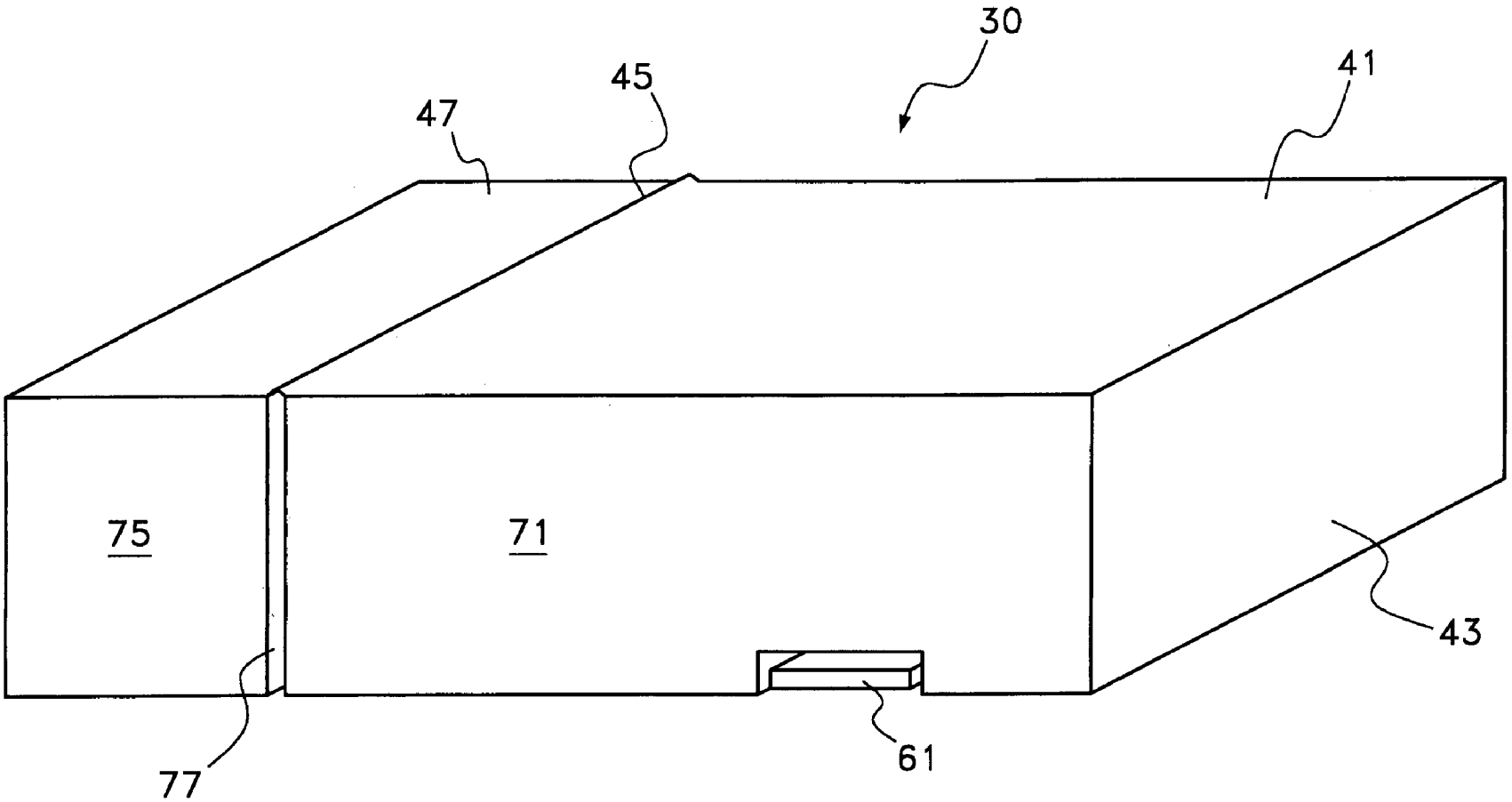
FIGS. 6 and 7 show an uncut oblique closed view, and an uncut oblique open view of the present invention container shown in the previous Figures, to illustrate the child resistant push and lift mechanism.
Figure 7:
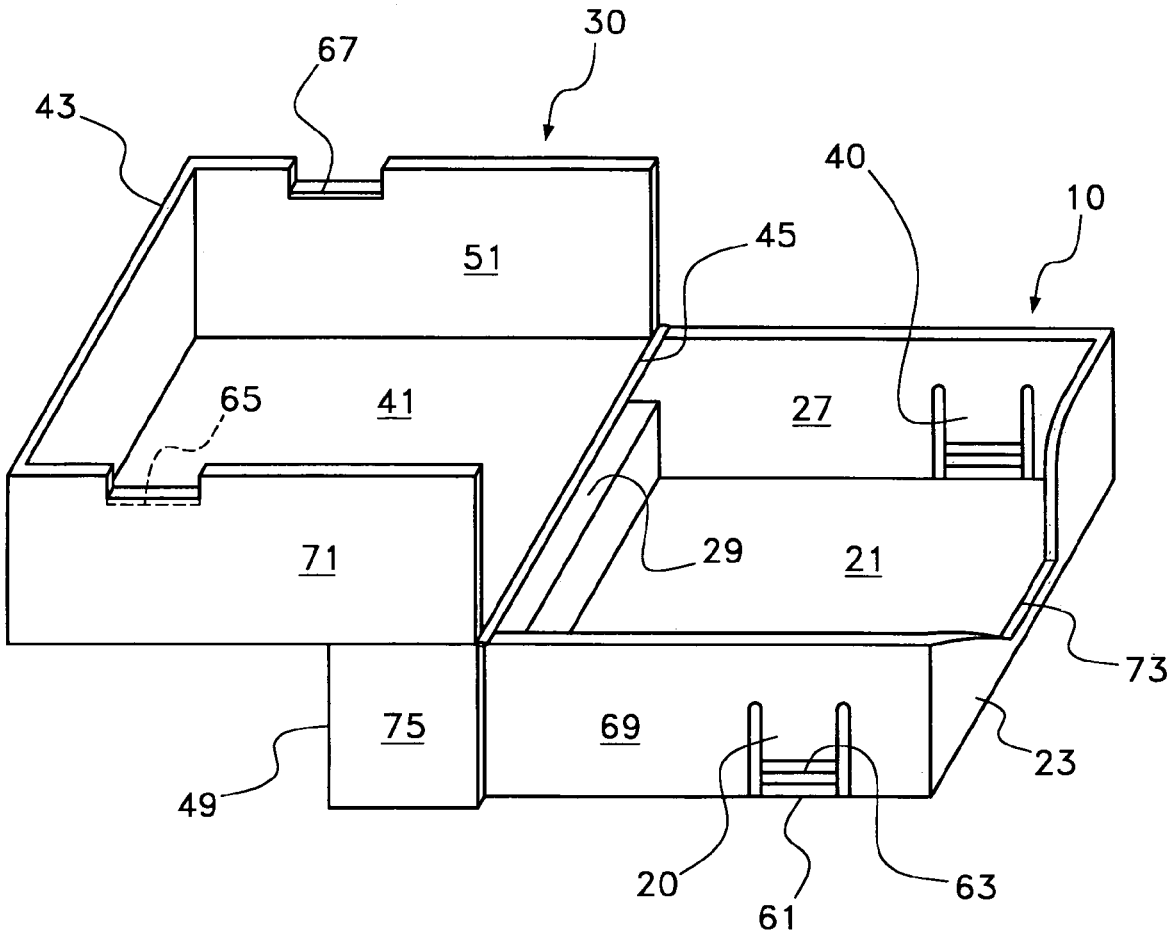

FIGS. 6 and 7 show an uncut oblique closed view, and an uncut oblique open view of the present invention container shown in the previous Figures, to illustrate the child resistant push and lift mechanism. Components shown above are identically numbered and need not be repeated here.

Bottom member side 69 and top member sides 71 and 75 were removed in the cut Figures above, but are symmetrical and opposite to their corresponding sides 27, 51 and 55 described above. Likewise, cut 77 corresponds to and is opposite cut 53 of FIG. 3.

In these FIGS. 6 and 7, more detail is shown in the push and lift mechanisms 20 and 40. Reference is specifically made to mechanism 20. It has a one way ratchet lip 63 that locks onto concomitant lip 65 on the top member 30 when closed. A user must press on bottom tab 61 to separate the lips so that lid top section 41 may be swung up to open the container.

Close to snap and lock as shown in closed position FIG. 6.

Figure 8:
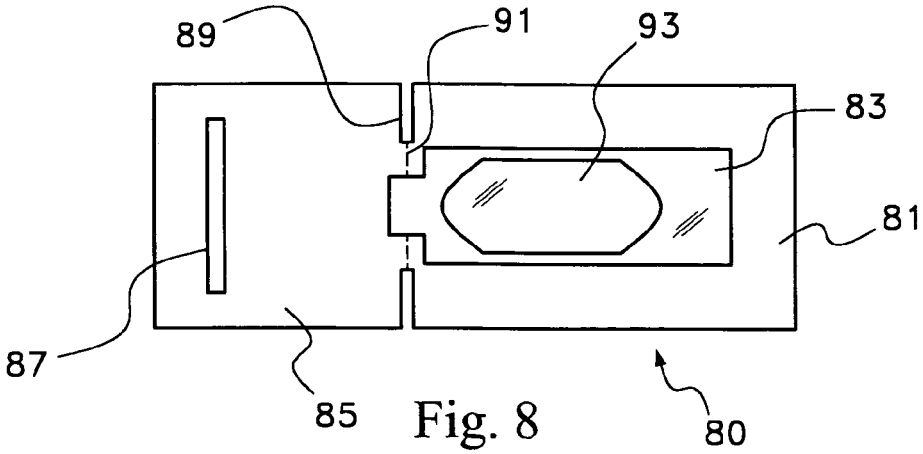
FIG. 8 shows a top view of an alternative present invention blister pack.

FIG. 8 shows a top view of an alternative present invention blister pack. Thus, pack 80 has a sealed end 81 and a locking end 85, separated by cuts, such as cut 89, and perforations 91. Rectangular cut out 87 would fit onto a vertical tongue for locking. When a user pulls on sealed end 81 to remove the medication, perforations 91 rip and the blister or pouch 83 rips to expose medication 93.

Figure 9:
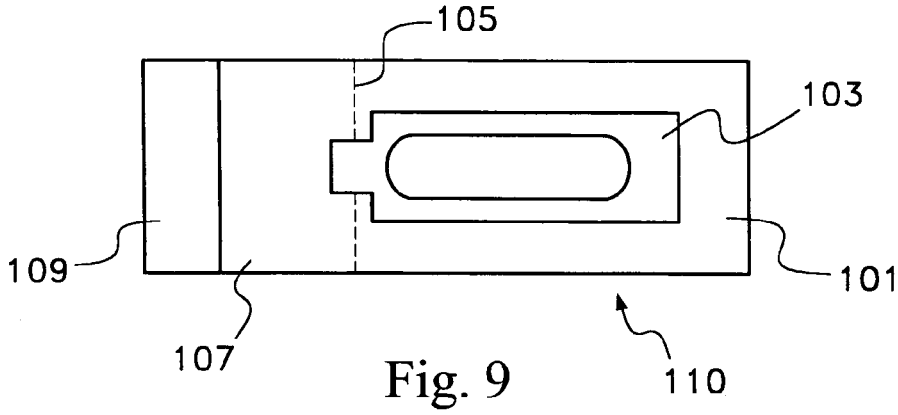
FIG. 9 shows a top view of another embodiment of a present invention blister pack and FIG. 10 shows a plurality of the FIG. 9 blister pack in a present invention child resistant container; and, FIGS. 11 and 12 show a top view of a present invention blister pack, and a side cut view of a present invention child resistant container holding a plurality of the FIG. 11 blister packs.
Figure 10:
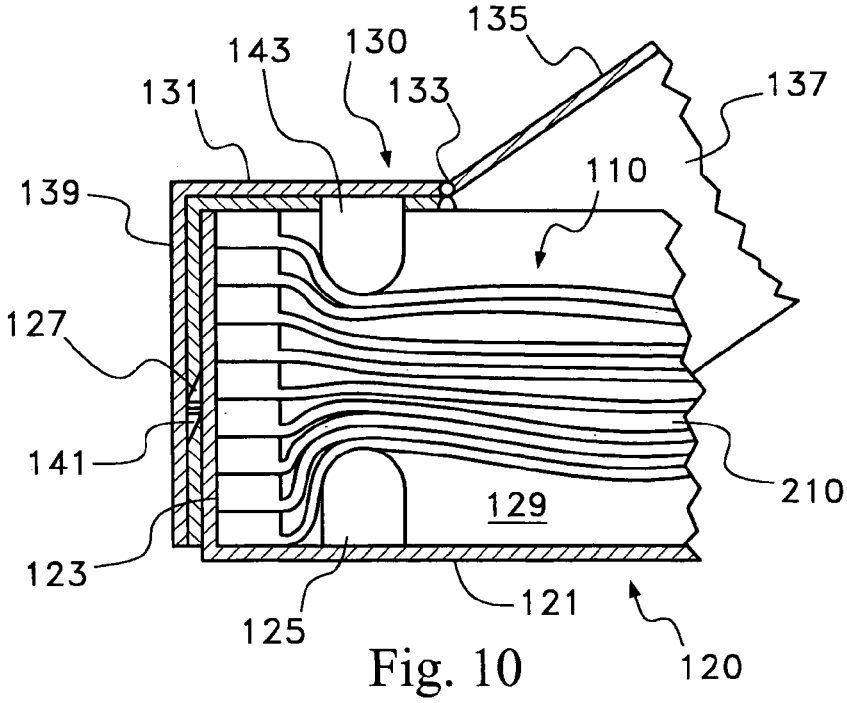

FIG. 9 shows a top view of another embodiment of a present invention blister pack and FIG. 10 shows a plurality of the FIG. 9 blister packs in a present invention child resistant container. The two FIGS. 9 and 10 are described together.

Blister pack 110 has a sealed end 101 and a locking end 107. Instead of locking end 107 having orifice(s) for locking as described above, there are increased thickness ends that act to prevent removal, such as thick end 109. This pack 110 has a blister 103 with a perforation 105 to work similarly to perforation 11 described in conjunction with FIG. 1 above.

Container bottom member 120 has a bottom 121, a back 123, sidewall 129 and pressure post 125. It also has a one way lock component 127 to operate with lock component 141 of top member 130 to keep the top and bottom from being separated once loaded with blister pack stack 210 and pushed together.

Top member 130 has a fixed top section 131 and a lid top section 135. Fixed top section 131 has sidewalls and a back 139 with lock component 141 described above. Lid top section 135 has sidewalls such as sidewall 137, a front (not shown) and is connected to fixed top section 131 by hinge 133. Pressure post 143 extends downwardly inside fixed top section 131, as shown . Stack 210 is a plurality of blister packs 110, and, when compressed by pressure post 125 and pressure post 143 acting together, along with the corresponding thick ends 109, prevent removal of a blister pack, resulting in the desired tear and medication exposure.

Figure 11:
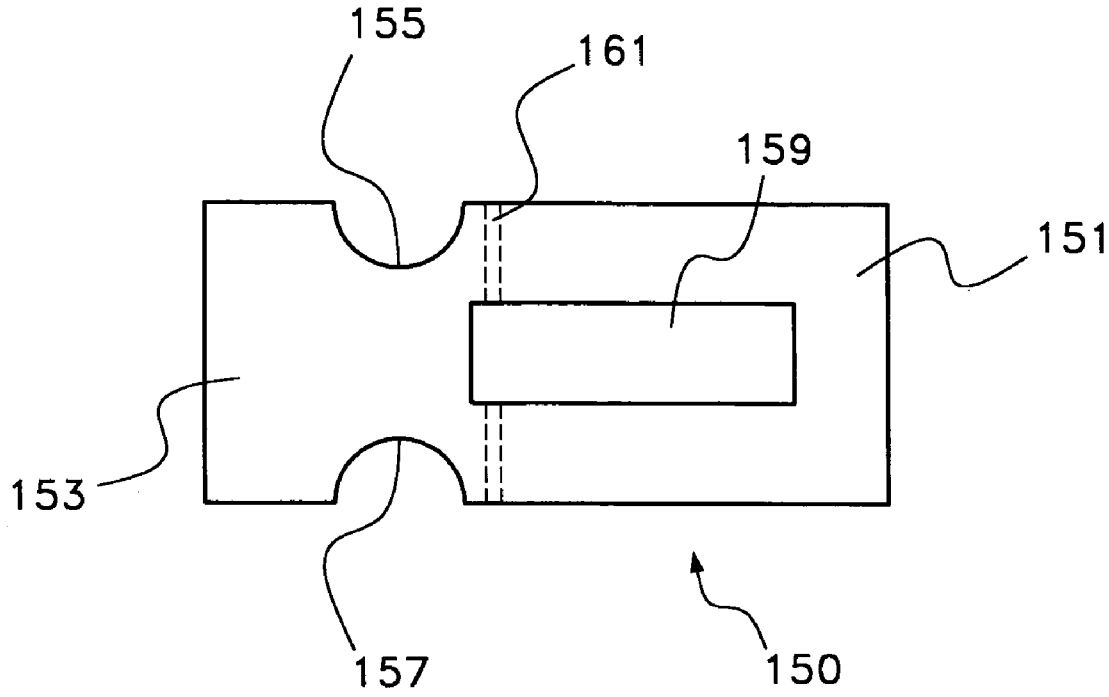
Figure 12:
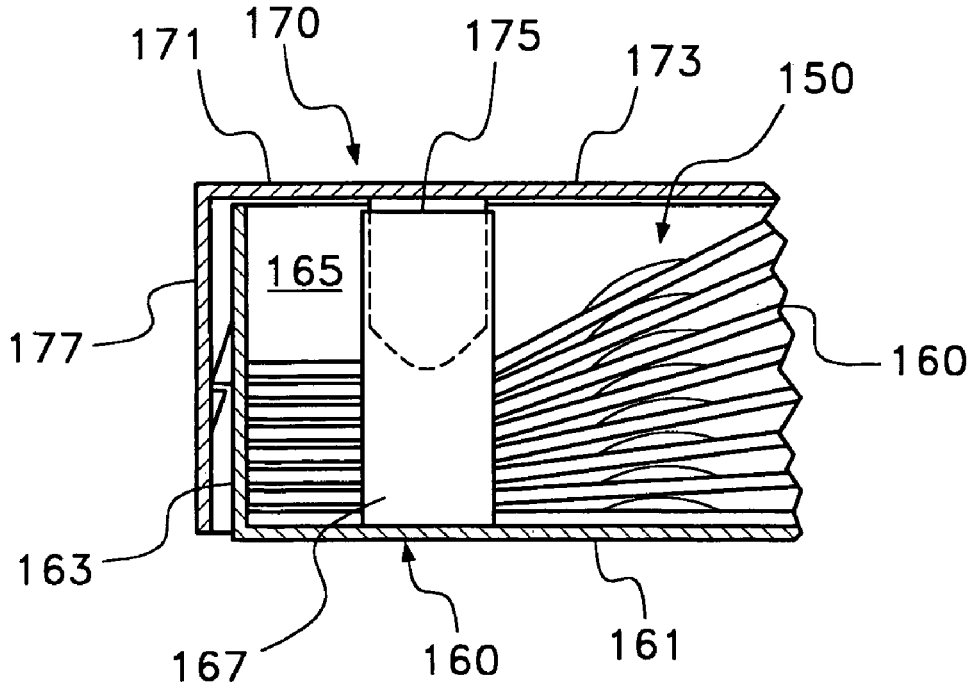

FIGS. 11 and 12 show a top view of a present invention blister pack, and a side cut view of a present invention child resistant container holding a plurality of the FIG. 11 blister packs.

Blister pack 150 has a sealed end 151 and a locking end 153. Instead of locking end 153 having orifice(s) or locking increased thickness ends as described above, there are opposing half circle cut outs 155 and 157 that act to prevent removal by encircling outside posts such as post 167. Pack 150 has a blister 159 with a double perforation 161 to work similarly to perforation 11 described in conjunction with FIG. 1 above.

Container bottom member 160 has a bottom 161, a back 163, sidewall 165 and the locking half post 167. It also has a one way lock component to operate with a lock component of top member 170, as shown, to keep the top and bottom from being separated once loaded with blister pack stack 160 and pushed together.

Top member 170 has a fixed top section 171 and a lid top section 173. Fixed top section 171 has sidewalls and a back 177 with a lock component as described above. Lid top section 173 has sidewalls, a front (not shown) and is connected to fixed top section 171 by a hinge. Pressure post 175 extends downwardly in the middle, inside fixed top section 173, as shown . Stack 160 is a plurality of blister packs 150, and, when compressed by pressure post 175 and wrapped around two outside half posts acting together prevent removal of a blister pack, resulting in the desired tear and medication exposure.

Obviously, numerous modifications and variations of the present invention are possible in light of the above teachings. For example, the blister packs need not contain medication, but contain other material that needs or is desirable to keep from children, such as epoxy, rat poison or other material that could be packaged in a plurality of blister packs. It is therefore understood that within the scope of the appended claims, the invention may be practiced otherwise than as specifically described herein.

What is claimed is:

1. A child resistant blister pack container for stacked blister packs, which comprises:

(a.) a bottom member having a bottom section, sidewalls, and a back section, and having a locking area located toward said back section, said locking area including at least a component of locking means for locking a stack of blister packs to said bottom member wherein said locking area includes a ledge raised above the bottom section to accommodate thickness differential between medication-free locking ends and sealed medication ends of a stack of blister packs;

(b.) a top member attached to said bottom member, said top member having a top section, sidewalls, and a back section, said top member having a fixed top section toward said back section, and having a lid top section hingedly connected to said fixed top section, said lid top section having an open upwardly hinged position and a closed position, wherein, when in said closed position, said lid top section closes onto said bottom member sidewalls; and, (c.) a child resistant push and lift mechanism, having a spring-based push tab and a tab lock, wherein said push tab has a locked position in its rest position and has an unlocked position in its pushed position, one of said push tab and said tab lock being attached to said bottom member and the other being attached to said top member, such that when said top member is in its closed position, said push tab is locked by said tab lock and said lid top section cannot be opened until said push tab is in its pushed position;

wherein when a stack of blister packs, each blister pack having a locking end and a sealed medication end with a breakaway mechanism therebetween so that a breakaway separates the sealed medication end from the locking end and unseals medication therein, are locked at said locking end with said at least one component of said bottom member, and said lid top section is closed, a user must push said push tab, lift said lid top section and breakaway a sealed medication end of a blister pack to procure medication from said container.

2. The child resistant blister pack container for stacked blister packs of claim 1 wherein said bottom member locking means component includes at least one post extending upwardly from said bottom member, and a clamping mechanism is also provided as a part of said container such that a stack of blister packs having corresponding perforations may be stacked on said at least one post and clamped in place.

3. The child resistant blister pack container for stacked blister packs of claim 2 wherein said clamping mechanism is connected to an underside of said fixed top section.

4. The child resistant blister pack container for stacked blister packs of claim 1 wherein said bottom member and said top member have rectangular top view shapes.

5. The child resistant blister pack container for stacked blister packs of claim 1 wherein said child resistant push and lift mechanism is located on said sidewalls.

6. The child resistant blister pack container for stacked blister packs of claim 5 wherein there are two opposing child resistant push and lift mechanisms on said sidewalls.

7. The child resistant blister pack container for stacked blister packs of claim 1 wherein said bottom member and said top member include interlocking means for permanent connection of said bottom member and said top member to one another.

8. The child resistant blister pack container for stacked blister packs of claim 1 wherein said push and lift mechanism push tab is integrally formed on one of said bottom member and said top member, and said tab lock is integrally formed on the other of said bottom member and said top member.

9. The child resistant blister pack container for stacked blister packs of claim 1 wherein there are two opposing child resistant push and lift mechanisms.

10. A child resistant blister pack container for stacked blister packs, which comprises:

(a.) a bottom member having a bottom section, sidewalls, and a back section, and having a locking area located toward said back section, said locking area including at least a component of locking means for locking a stack of blister packs to said bottom member wherein said locking area includes a ledge raised above the bottom section to accommodate thickness differential between medication-free locking ends and sealed medication ends of a stack of blister packs;

(b.) a top member attached to said bottom member, said top member having a top section, sidewalls, and a back section, said top member having a fixed top section toward said back section, and having a lid top section hingedly connected to said fixed top section, said lid top section having an open upwardly hinged position and a closed position, wherein, when in said closed position, said lid top section closes onto said bottom member sidewalls;

(c.) a child resistant push and lift mechanism, having a spring-based push tab and a tab lock, wherein said push tab has a locked position in its rest position and has an unlocked position in its pushed position, one of said push tab and said tab lock being attached to said bottom member and the other being attached to said top member, such that when said top member is in its closed position, said push tab is locked by said tab lock and said lid top section cannot be opened until said push tab is in its pushed position; and, (d.) a plurality of stacked blister packs each blister pack having a locking end and an opposing sealed medication end with a breakaway mechanism therebetween so that in a single breakaway action by a user, the sealed medication end separates from the locking end and the blister pack is automatically opened to expose previously sealed medication therein, said plurality of stacked blister packs being locked at said locking end with said at least one component of locking means of said bottom member;

wherein when said lid top section is closed, a user must push said push tab, lift said lid top section and breakaway a sealed medication end of a blister pack to procure medication from said container.

11. The child resistant blister pack container for stacked blister packs of claim 10 wherein said at least one component of locking means includes at least one post extending upwardly from said bottom member, and a clamping mechanism is also provided as a part of said container such that a stack of blister packs having corresponding perforations may be stacked on said at least one post and clamped in place.

12. The child resistant blister pack container for stacked blister packs of claim 11 wherein said clamping mechanism is connected to an underside of said fixed top section.

13. The child resistant blister pack container for stacked blister packs of claim 10 wherein said bottom member and said top member have rectangular top view shapes.

14. The child resistant blister pack container for stacked blister packs of claim 10 wherein said child resistant push and lift mechanism is located on said sidewalls.

15. The child resistant blister pack container for stacked blister packs of claim 14 wherein there are two opposing child resistant push and lift mechanisms on said sidewalls.

16. The child resistant blister pack container for stacked blister packs of claim 10 wherein said bottom member and said top member include interlocking means for permanent connection of said bottom member and said top member to one another.

* * * * *